United States Patent [19]

Yoshimura et al.

[11] 4,225,348

[45] Sep. 30, 1980

[54] LIME BEARING AGENT FOR USE IN REFINING OF FERROUS MELT

[75] Inventors: Ryoichi Yoshimura, Yokohama; Munetaka Honda, Nyuzenmachi; Norio Hirokawa, Chichibu, all of Japan

[73] Assignee: Showa Denko Kabushiki Kaisha, Tokyo, Japan

[21] Appl. No.: 25,478

[22] Filed: Mar. 30, 1979

[30] Foreign Application Priority Data

Apr. 4, 1978 [JP] Japan ..... 53-38781

[51] Int. Cl.[2] ..... C22B 9/10

[52] U.S. Cl. ..... 75/257; 75/53; 75/58

[58] Field of Search ..... 75/10 R, 53, 58, 257

[56] References Cited

U.S. PATENT DOCUMENTS

| | | | |
|---|---|---|---|
| 3,551,137 | 12/1970 | Bnat | 75/10 R |
| 3,802,865 | 4/1974 | Ohkubo | 75/53 |
| 4,097,269 | 6/1978 | Holzgruber | 75/53 |

FOREIGN PATENT DOCUMENTS

| | | | |
|---|---|---|---|
| 979583 | 1/1965 | United Kingdom | 75/10 R |

*Primary Examiner*—P. D. Rosenberg
*Attorney, Agent, or Firm*—J. Harold Nissen

[57] ABSTRACT

A slaking property of a lime bearing agent for use in the refining, particularly in the injection refining, of a ferrous melt is essentially eliminated by providing the agent with a special form, i.e. an uncrushed, granular form solidified from molten drops. Hydrogen pick up of the ferrous melt from the refining agent is avoided and an excellent refining effect of the ferrous melt is achieved by the refining agent of the present invention.

6 Claims, 1 Drawing Figure

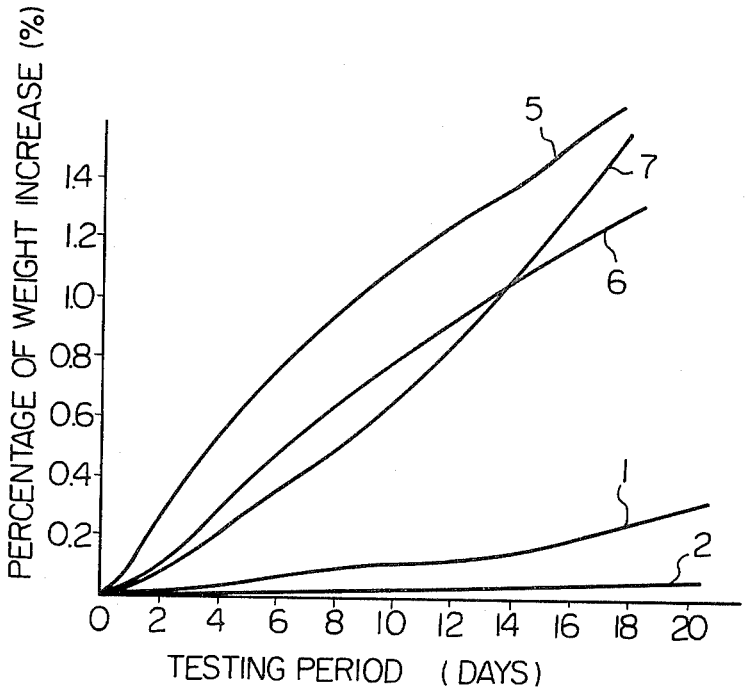
PERCENTAGE OF WEIGHT INCREASE (%)
1.4
1.2
1.0
0.8
0.6
0.4
0.2
0
2
4
6
8
10
12
14
16
18
20
TESTING PERIOD (DAYS)
5
7
6
1
2

LIME BEARING AGENT FOR USE IN REFINING OF FERROUS MELT

The present invention relates to a lime bearing agent for use in the refining of a ferrous melt. In the refining of a ferrous melt, molten steel has been treated by adding a refining agent thereto for the purpose of desulfurization, deoxidization and the like. According to an injection treatment method, the refining agent or flux in a granular or powdered form is blown into the molten steel by means of high pressure gas. In addition to the injection of the lime bearing agent mentioned above, the treatment of a ferrous material by such agent is also performed in the electroslag refining method and the continuous casting method.

It is known that the refining agent for use in the treatment mentioned above may be such an agent as a calcium silicon alloy, a calcium carbide or a mixture of calcium oxide, calcium fluoride, aluminum oxide and the like.

The calcium silicon alloy is not efficient for treating the molten steel, because the metallic calcium is liable to vaporize at an elevated temperature of the molten steel. The calcium silicon alloy leads to an increase in the silicon level in the molten steel and, moreover, the calcium of such alloy reduces the alumina contained in the refractory of a vessel for treating the molten steel. As a result of the alumina reduction, aluminum is generated from the refractory, and thus, the aluminum level in the molten steel is disadvantageously increased.

It has long been known that calcium carbide ($CaC_2$) has a desulfurizing effect on a ferrous melt. Calcium carbide, however, disadvantageously increases the carbon level of the molten steel, and therefore, is not recommended for treating an extremely low carbon steel.

It has been proposed that in the art of ferrous refining, the powders of calcium oxide (CaO), calcium fluoride ($CaF_2$) and alumina ($Al_2O_3$) be mixed or alternatively mixed, sintered and then crushed into granules. However, since an eutectic composition of these powders and granules is not formed therein, the melting of the powders and granules is realized after their addition into the ferrous melt. Accordingly, particularly when the treatment of ferrous melt is carried out by the injection of the powder mixtures and the granules produced by crushing the sintered mixtures, mentioned above, these powders and granules, which do not refine the ferrous melt enough, float to the surface of the ferrous melt bath.

It has also been proposed, in German Offenlegungsschrift No. 25 45 340 that, in order to remove the disadvantages of the known, powder mixtures and the granules produced by crushing the sintered mixtures, mentioned above, a refining agent mixture be melted, cast and, then the solidified mixture be crushed into powders or granules.

The Inventors tested the slaking property of the known refining agents and discovered the following facts. Namely, the granular refining agent composition containing calcium oxide (CaO) undergoes pulverization during which the calcium hydroxide is formed in the agent by the reaction of the moisture in the air with the calcium oxide, which generally has a slaking property. It is not only difficult to handle the slaked refining agent, but also, disadvantageous to add such an agent into the molten steel because of a considerable increase in the hydrogen content of the molten steel. The slaking resistance of the lime bearing refining agent becomes higher in the order, the powder mixture, the powders of the sintered mixture and the melted solidified, and crushed powders. However, the slaking resistance of solidified and crushed powders, which exhibit the best slaking resistance in the known refining agents, is still not enough.

It is necessary to use a large amount of mechanical energy to crush the solidified, refining composition, which is produced by an electro fusing technique. Furthermore, in the crushing, it is difficult to obtain powders having a uniform grain size at high yield.

It is an object of the present invention to provide a lime bearing agent for use in the treatment, particularly refining, of a ferrous melt, which agent exhibits a superior slaking resistance to the solidified and then crushed powders or granules, and which agent reduces the hydrogen absorption of the ferrous melt to a level lower than that obtainable by the known lime bearing agents.

In accordance with the object of the present invention there is provided a lime bearing granular agent for use in the treatment of a ferrous melt, said agent having a good resistance against slaking, having a granular form solidified from molten drops, and comprising from 15 to 100% of a calcium oxide, from 0 to 85% of at least one member selected from the group consisting of a calcium fluoride and an aluminum oxide, from 0 to 10% of a magnesium oxide, from 0 to 10% of a silicon oxide, and from 0 to 10% of an iron oxide or oxides.

The granular, lime bearing agent for use in the refining of ferrous melt according to the present invention has such a composition structure that the granules, which are spherical or substantially spherical, are solidified from molten drops. Namely, the solidified drops are used for the refining of the ferrous melt without crushing them. The granular, lime bearing refining agent according to the present invention, therefore, has a relatively smooth surface and not a crushed surface. According to another conspicious structure of the granular lime bearing agent according to the present invention, each of the granules consists of fine crystals having essentially the same grain size from the surface to the interior thereof. The structure of the granular lime bearing agent according to the present invention is completely different from the structure of the granules obtained by crushing the cast lime bearing agent. Namely, the surface of the crushed agent possesses a number of corners and is not smooth. In addition, since the inner part of the cast lime bearing agent cannot be rapidly cooled, the crushed granules of the cast body include crystals larger than those of the present invention. It was demonstrated by the Inventors that the crushed granules disadvantageously exhibit poor resistance against slaking due to the crushed surface of the granules. The disadvantage of the crushed granules is removed according to the granular structure of the present invention. Namely, molten drops having a predetermined composition are rapidly cooled, and thus solidified, and the solidified drops are directly used as the finished article of the refining agent of the ferrous melt. These granules are not crushed and, thus, do not have a crushed surface, and moreover, these granules are rapidly cooled from the surface to interior thereof and are, therefore, fine crystalline from the surface to the interior thereof. The grain size of the granules is essentially not more than 2 mm. Since the refining agent according to the present invention has an improved resistance against slaking, the weight of the refining agent due to moisture absorption increases slowly at a rate of not more than approximately 0.02%/day. Contrary to this, the weight increase rate of the known, crushed refining agent is from 0.6 to 0.7%/day and, thus, is considerably higher. The refining agent having a high resistance against slaking according to the present invention is advantageous in the fact that such agent can be easily handled and stored, and in addition, does not increase the hydrogen content of molten steel.

The composition of the lime bearing agent according to the present invention is hereinafter explained.

Calcium oxide (CaO) is a component for achieving the refining effect of a terrous melt. When the content of calcium oxide is 30% or higher, the activity thereof, and thus the refining effect, is high. The content of calcium oxide can be lowered to 15% when the refining agent is used in an electroslag remelting method, because in such method, the electric conductivity of the refining agent is adjusted to a low level by reducing the calcium oxide content. The calcium oxide may be contained in the refining agent in an amount of 100%, except for the amount of impurities which are inevitably contained in the agent, in a case when the granular uncrushed lime according to the present invention is used in combination with the refining agent, which are crushed into granules. In a case where the refining agent comprises other component(s) than the lime useful for treating the ferrous melt, such agent may be used alone for the treatment of the ferrous melt, namely, without the joint use of the crushed component to be added to the ferrous melt.

The calcium fluoride ($CaF_2$) and aluminum oxide ($Al_2O_3$) reduce the melting point and viscosity of the lime bearing agent, and thus, should be added to the agent. In addition, the calcium fluoride and aluminum oxide increase the electrical conductivity of the lime-bearing agent for electroslag remelting. With the increase in the content of calcium fluoride and/or aluminum oxide, the activity of the calcium oxide (CaO) becomes lower and the refinability of the lime bearing agent is, thus, considerably decreased. Accordingly, the content of either $CaF_2$ or $Al_2O_3$, or the total content of $CaF_2$ and $Al_2O_3$, should be 70% or lower.

The magnesium oxide (MgO), silicon oxide ($SiO_2$) and iron oxides ($Fe_2O_3$, FeO and the like) are harmful to the desulfurizing reaction of the ferrous melt, and therefore, each of these oxides must be limited to an amount not exceeding 10%. The lower the content of these oxides, the better is the desulfurizing effect. It is, however, inevitable in most cases that these oxides from the raw materials of the lime bearing refining agent or from the wall of a melting furnace of such agent are brought into the refining agent. However, when the content of each of these oxides is 10% or lower, the lime bearing agent exhibits the refining effect to a practical extent.

The refining agent according to the present invention achieves a high refining effect when used for the injection refining in which the granular agent is blown into the ferrous melt by loading the same in an inert gas, for example, argon gas, so as to desulfurize, deoxidize and dephosphorize the melt. The spherical or nearly spherical form of the granular lime bearing agent according to the present invention makes the agent particularly suitable for blowing. It is preferable to blow the refining agent in an amount of from 0.1 to 0.5% of the ferrous melt. A preferable composition of the lime bearing agent for injection refining is from 55 to 70% of calcium oxide (CaO), from 15 to 35% of calcium fluoride ($CaF_2$), from 10 to 30% of aluminum oxide ($Al_2O_3$), the total content of calcium fluoride and aluminum oxide being in the range of from 30 to 45%, and not more than 5% of each of magnesium oxide (MgO), silicon oxide ($SiO_2$) and iron oxide(s). It is preferable, in view of the high refining effects, that this composition be melted, and solidified as a whole. However, it is also possible to melt and solidify only the lime (CaO) in the granular form, and to mix such components as calcium fluoride ($CaF_2$) and alumina ($Al_2O_3$), prepared by any conventional process, with the granular lime in an amount of 30% of the whole mixture.

The refining agent according to the present invention can be used for the electroslag refining, when such refining agent comprises the calcium oxide (CaO) in an amount of from 15 to 55% and at least one of calcium fluoride ($CaF_2$) and aluminum oxide ($Al_2O_3$) in an amount of from 40 to 80%. The maximum amount of the CaO should be 55%, so as to not reduce the electric conductivity of the molten slag, i.e. the molten refining agent.

The refining agent according to the present invention may also be used as the casting flux in the continuous casting of steel.

Several processes for producing the refining agent according to the present invention will now be illustrated.

According to one of the production processes, the raw materials, such as lime, fluorspar, alumina and the like, are mixed in the composition range mentioned above and melted in a tiltable, electric furnace. Upon melting, the melt is flown down as a stream by tilting the furnace, to which stream a gas, such as compressed air, is blown through a nozzle so as to blow off the melt. The blown melt is turned into molten drops and, then, solidified by a rapid cooling. The size of the granular refining agent varies to some extent with the variance in the blowing condition of the melt, but most of the grains do not exceed 2 mm. The pressure of the blowing air is preferably in the range of from 2 to 7 kg/cm$^2$.

The air-blowing rate should be adjusted in terms of the following formula.

$$\frac{\text{Flowing rate of melt (kg/minute)}}{\text{Blowing rate of air (kg/minute)}} = 3.2 - 25$$

It is possible to produce the granular refining agent by another production process, wherein the melt is flown down onto a rotating disc, the granulated melt is scattered from the circumferential portion of the disc by a centrifugal force and is rapidly cooled. According to this process, solid spheres are obtained under almost all producing conditions. The rotational speed of the disc at the periphery thereof is preferably from 250 to 1300 m/minute.

The present invention is explained further in detail with reference to Examples and the drawing, which indicates the weight increase of several granular refining agents.

EXAMPLE 1

Limestone, fluorspar, a Bayer alumina, magnesia, silica and a red iron oxide, as the raw materials, were melted in an arc furnace. The melt so obtained was tapped from the furnace as a stream, which was blown off by compressed air through a nozzle. The blowing condition was: the ratio of the melt flowing-down rate (kg/min) with respect to the air blowing rate (kg/min)=7; and; the pressure of air at the nozzle=5 kg/cm$^2$. The so obtained granules had the following distribution of grain size:

Under 1000 microns: 65% by weight

From 1000 to 2380 microns: 28% by weight

More than 2380 microns: 7% by weight

The composition of the granular refining agents according to the present invention, produced in the present Example, was as shown in Table 1 by reference numerals Nos. 1 through 4. For the purpose of comparison with these granular, refining agents, the following refining agents were produced. First, powders having almost the same size distribution as that mentioned above were mixed, the obtained refining agent being denoted as No. 5 hereinafter. Second, a sintered article at a temperature of 1300° C. was then crushed so that it had the same size distribution as that mentioned above. The refining agent so produced is hereinafter denoted as No. 6. Third, a melt was cast or solidified and, then, the solidified article was crushed. The refining agent so produced is denoted hereinafter as No. 7.

TABLE 1

| No. | Components (wt %) | | | | | |
|---|---|---|---|---|---|---|
| | CaO | $CaF_2$ | $Al_2O_3$ | MgO | $SiO_2$ | $Fe_2O_3$ |
| 1 (invention) | 98 | none | 0.1 | 1 | 0.5 | 0.1 |
| 2 (invention) | 65 | 16 | 15 | 2 | 1 | 1 |
| 3 (invention) | 50 | 25 | 20 | 2 | 2 | 1 |
| 4 (invention) | 30 | 37 | 30 | 1 | 1 | 1 |
| 5 (control) | 65 | 16 | 15 | 2 | 1 | 1 |
| 6 (control) | 65 | 16 | 15 | 2 | 1 | 1 |
| 7 (control) | 65 | 16 | 15 | 2 | 1 | 1 |

Test of Resistance against Slaking

Refining agents Nos. 1, 2, 5, 6 and 7 in an amount of 10 grams were placed on a dish and, then, exposed at 30° C. to air having a humidity of 90%. The weight increase of the samples due to moisture absorption with the lapse of time was measured. The measurement results are shown in the single drawing, wherein the abscissa and ordinate represent the lapse of days and the increasing rate of weight (%), respectively. It is clear from the drawing that the resistance of the refining agents according to the present invention against slaking is high.

Test of Refining a Molten Steel

The refining agents Nos. 1 through 3 and 5 through 7 were exposed to the air mentioned above over 15 days and blown into 30 kg of molten steel in a magnesia crucible of a high frequency induction furnace, by means of an alumina tube having an 8 mm diameter. The refining agents were blown together with an argon gas, which was blown through the alumina tube at a rate of 4 l/minute. The blowing rate of the refining agents into the molten steel having a temperature of 1600° C. was 15 grams/minute and the blowing period lasted 15 minutes. The impurities of the molten steel were analyzed prior and subsequent to the blowing. The analysis results were as shown in Table 2. In Table 2, the Sample No. 1 (2) designates the mixture in which the Sample No. 1 and conventional powders $CaF_2$ and $Al_2O_3$ were mixed, so as to adjust the composition of the mixture to that of Sample No. 2.

TABLE 2

| Refining Agents | | Impurities (wt %) | | | |
|---|---|---|---|---|---|
| | | S | O | P | H |
| Before Blowing | | 0.030 | 0.015 | 0.015 | 0.0003 |
| After Blowing | 1(2) Invention | 0.020 | 0.015 | 0.015 | 0.0004 |
| | 2 Invention | 0.010 | 0.003 | 0.008 | 0.0003 |
| | 3 Invention | 0.013 | 0.005 | 0.012 | 0.0003 |
| | 5 Control | 0.020 | 0.015 | 0.014 | 0.0015 |
| | 6 Control | 0.012 | 0.005 | 0.014 | 0.0009 |
| | 7 Control | 0.012 | 0.005 | 0.012 | 0.0009 |

As will be apparent from Table 2, the hydrogen content of the steel treated by the use of the refining agents Nos. 5, 6 and 7 is increased, while the hydrogen content of the steel treated by the refining agents Nos. 1(2), 2 and 3 remains at essentially the same level as before the treatment. In comparing the impurity content after treatment of the refining agents Nos. 2 and 7, each having the same composition, it will be apparent that the sulphur, oxygen and phosphorus contents, of the steel treated by the Sample No. 2 are lower than those treated by Sample No. 7. In addition, although the Samples Nos. 1(1) and 2 have the same composition, the refining effects of the latter are higher than the former.

EXAMPLE 2

A lime bearing agent consisting of 30% of CaO and the balance of $CaF_2$ was produced by using the same procedure as that described in Example 1, and was used as a slag in an electroslag remelting process, which was carried out under the following conditions.

Steel treated by electroslag remelting: SUS304(18Cr-8Ni)

Capacity of electric source: 500 KVA

Current: 500 amperes-AC

Ingot weight: 5 kg

Slag weight: 300 g

An electrode consisting of the steel mentioned above contained 0.020% of sulfur and 4 ppm (0.0004 wt%) of hydrogen and was refined by the electroslag remelting method to a level of 0.005% of sulfur. The hydrogen content of the refined steel was 4 ppm.

For the purpose of comprising the conventional refining agent with the solidified refining agent, the crushed powder of CaO in an amount of 30% the crushed powder of $CaF_2$ in an amount of 70% were mixed together and used as the slag of the electroslag refining method under the conditions mentioned above. The sulfur and hydrogen contents of the refined steel (SUS304) were 0.008% and 10 ppm, respectively.

What we claim is:

1. A lime bearing granular agent for use in refining of a ferrous melt, said agent having a good resistance against slaking, each of the granules having a granular form solidified from molten drops, and consisting essentially of from 15 to 100% of calcium oxide, from 0.1 to 85% of at least one member selected from the group consisting of a calcium fluoride and an aluminum oxide; and not exceeding 10% of a magnesium oxide, 10% of a silicon oxide, and 10% of an iron oxide or oxides, said magnesium oxide, silicon oxide and iron oxides being derived from the raw materials of lime bearing refining agents or the refractories of a melting furnace.

2. A lime bearing granular agent according to claim 1, wherein said agent is for use in an injection treatment of the ferrous melt and comprises from 55 to 70% of the calcium oxide, from 15 to 35% of the calcium fluoride, from 10 to 30% of the aluminum oxide, the total content of said calcium fluoride and said aluminum oxide being from 30 to 45%, and to 5% of the magnesium oxide, from 5% of the silicon dioxide, and 5% of the iron oxide or oxides, and due to said form and composition of said agent, the ferrous melt is desulphurized, deoxidized and dephosphrized while maintaining the hydrogen level of said ferrous melt at essentially the same level as that before said injection treatment.

3. A lime bearing granular agent according to claim 1, wherein said agent is for use in an electroslag refining and comprises from 15 to 55% of the calcium oxide and from 40 to 80% of at least one member selected from the group consisting of the calcium fluoride and aluminum oxide.

4. A lime bearing refining agent according to claim 1, 2 or 3, wherein each of the granules consist of fine crystals having essentially the same grain size from the surface to the interior of the granules.

5. A lime bearing refining agent according to claim 4, wherein the grain size of said granules is essentially not more than 2 mm.

6. A lime bearing refining agent according to claim 1, 2 or 3, wherein the rate of weight increase of said refining agent due to moisture absorption is not more than approximately 0.02% per day.

* * * * *